US010336572B2

(12) United States Patent
Hall et al.

(10) Patent No.: US 10,336,572 B2
(45) Date of Patent: Jul. 2, 2019

(54) COMPACT INFLATOR

(71) Applicants: David R. Hall, Provo, UT (US); Jerome Miles, Spanish Fork, UT (US); Davido Hyer, Spanish Fork, UT (US); Jedediah Knight, Provo, UT (US)

(72) Inventors: David R. Hall, Provo, UT (US); Jerome Miles, Spanish Fork, UT (US); Davido Hyer, Spanish Fork, UT (US); Jedediah Knight, Provo, UT (US)

(73) Assignee: Hall Labs LLC, Provo, UT (US)

( * ) Notice: Subject to any disclaimer, the term of this patent is extended or adjusted under 35 U.S.C. 154(b) by 0 days.

(21) Appl. No.: 15/426,556

(22) Filed: Feb. 7, 2017

(65) Prior Publication Data

US 2018/0222715 A1 Aug. 9, 2018

(51) Int. Cl.

| | |
|---|---|
| ***F04B 35/04*** | (2006.01) |
| ***B65H 75/44*** | (2006.01) |
| ***F04B 39/00*** | (2006.01) |
| ***F04B 35/01*** | (2006.01) |
| ***F04B 39/12*** | (2006.01) |
| ***F04B 41/00*** | (2006.01) |

(52) U.S. Cl.

CPC ..... *B65H 75/4486* (2013.01); *B65H 75/446* (2013.01); *B65H 75/4428* (2013.01); *B65H 75/4471* (2013.01); *B65H 75/4478* (2013.01); *B65H 75/4484* (2013.01); *F04B 35/01* (2013.01); *F04B 35/04* (2013.01); *F04B 39/00* (2013.01); *F04B 39/123* (2013.01); *F04B 41/00* (2013.01); *B65H 2701/33* (2013.01)

(58) Field of Classification Search

CPC ..... F04B 35/04; F04B 37/00; B65H 2701/33; B65H 75/48; B65H 75/4471

USPC ..... 137/355.2, 355.23

See application file for complete search history.

(56) References Cited

U.S. PATENT DOCUMENTS

| | | | | |
|---|---|---|---|---|
| 2004/0163710 | A1* | 8/2004 | Kovacik | B65H 75/38 137/355.23 |
| 2008/0213089 | A1* | 9/2008 | McCurry | F04B 41/06 415/204 |
| 2015/0308425 | A1* | 10/2015 | Skotty | F04B 35/06 137/565.18 |
| 2017/0129351 | A1* | 5/2017 | Bianco | B60L 11/1818 |
| 2017/0267114 | A1* | 9/2017 | Bianco | B60L 3/04 |

* cited by examiner

*Primary Examiner* — Marina A Tietjen
*Assistant Examiner* — Paul J Gray

(57) ABSTRACT

A compact inflator is described herein. The inflator may include a rotatable drum, an air pump disposed within the drum, a fixed securing mechanism that provides structural support to, and enables rotation of, the drum, a power supply, and an electric power transmission mechanism. The drum may draw in and let out a hose. The hose may have a first end and a second end, the first end having a connection mechanism that connects the hose to an inflatable object. The air pump may be connected to the second end of the hose. The power supply may provide power to the motor, and may be coupled to the pump or the power supply. The power transmission mechanism may include a slip ring assembly or a pair of parallel inductors, one which rotates with the drum about the other.

14 Claims, 12 Drawing Sheets

COMPACT INFLATOR

CROSS-REFERENCES

This application refers to, and incorporates, various parts of U.S. patent application Ser. No. 15/413,905 by David R. Hall et al., filed on Jan. 24, 2017. Those parts of the referenced application not explicitly incorporated, by reference or otherwise, are hereby incorporated by reference, such that the entirety of the referenced application is incorporated herein by reference.

TECHNICAL FIELD

This invention relates generally to the field of inflators and compressors.

BACKGROUND

Compressors and inflators are essential tools for at-home workshops and well-equipped home garages. Despite this, little innovation has been seen recently beyond incorporating sometimes-inaccurate digital read-outs. The standard inflator or compressor includes a hose, a coupling mechanism that allows the hose to be coupled to various inflatable objects and/or tools that use compressed air, a pump that is switched on and off locally, and a pressure gauge. Typically, the switch to operate the pump is on the pump or pump housing, thus requiring the pump to be placed where it can be conveniently reached. Unfortunately, in many cases, the most convenient place for the pump is "out of the way," meaning the user must move between where the pump is located and where the object or tool is located.

Other problems include size, hose length, and hose management. Typically, smaller inflators/compressors have shorter hoses because the smaller design makes the inflator more portable. However, it can be desirable to have a smaller inflator in a fixed location, which may require a longer hose, with additional infrastructure to support and/or manage the hose.

Some solutions to the inconvenience of positioning the pump have been presented. One includes filling a tank with compressed air and having the valve to the tank located at the operable end of the hose. Another includes placing the pump switch at the operable end of the hose and running wiring for the switch along the hose. Both solutions have drawbacks. The tank solution requires finding extra room for a tank, and the switch solution requires a bulkier and less flexible hose. Additionally, some solutions have been presented for addressing hose management issues, but solutions addressing size and hose management are still heavy, bulky, and/or have other associated inconveniences. Thus, there is still room for improvement to compressors and inflators.

SUMMARY OF THE INVENTION

An inflator is described herein that addresses at least some of the issues described above. The inflator may include a rotatable drum, an air pump disposed within the drum, a fixed securing mechanism that provides structural support to, and enables rotation of, the drum, a power supply, and an electric power transmission mechanism. The drum may draw in and let out a hose. The hose may have a first end and a second end, the first end having a connection mechanism that connects the hose to an inflatable object. The air pump may be connected to the second end of the hose. The power supply may provide power to the mum, and the power transmission mechanism may be coupled to one or more of the pump or the power supply. The power transmission mechanism may include a first portion coupled to the securing mechanism and second portion coupled to the drum. Examples may include a slip ring assembly and a pair of parallel inductors, one which rotates with the drum about the other.

The inflator described above addresses the shortcomings of previous solutions in several ways. For example, the inflator summarized above may be more compact than other solutions, such as those described in the background, while still allowing for a long hose. The inflator summarized above may also require less materials, because the same structure may be used to support and/or house both the pump and the hose. Significant sound attenuation may also be achieved using less materials than other solutions. Other solutions have been unable to achieve such results because, among other reasons, providing external power to a motor fixed to a rotatable drum has not been possible. The power transmission mechanism enables rotation of the drum while still providing continuous, reliable power to the pump.

BRIEF DESCRIPTION OF THE DRAWINGS

A more particular description of the inflators briefly described above is made below by reference to specific embodiments. Several embodiments are depicted in drawings included with this application, in which.

DETAILED DESCRIPTION

A detailed description of embodiments of a compact inflator is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

The descriptions of the various embodiments include, in some cases, references to elements described with regard to other embodiments. Such references are provided for convenience to the reader, and to provide efficient description and enablement of each embodiment, and are not intended to limit the elements incorporated from other embodiments to only the features described with regard to the other embodiments. Rather, each embodiment is distinct from each other embodiment. Despite this, the described embodiments do not form an exhaustive list of all potential embodiments of the claimed invention; various combinations of the described embodiments are also envisioned, and are inherent from the descriptions of the embodiments below. Additionally, embodiments not described below that meet the limitations of the appended claims are also envisioned, as is recognized by those of skill in the art.

Figure 1:
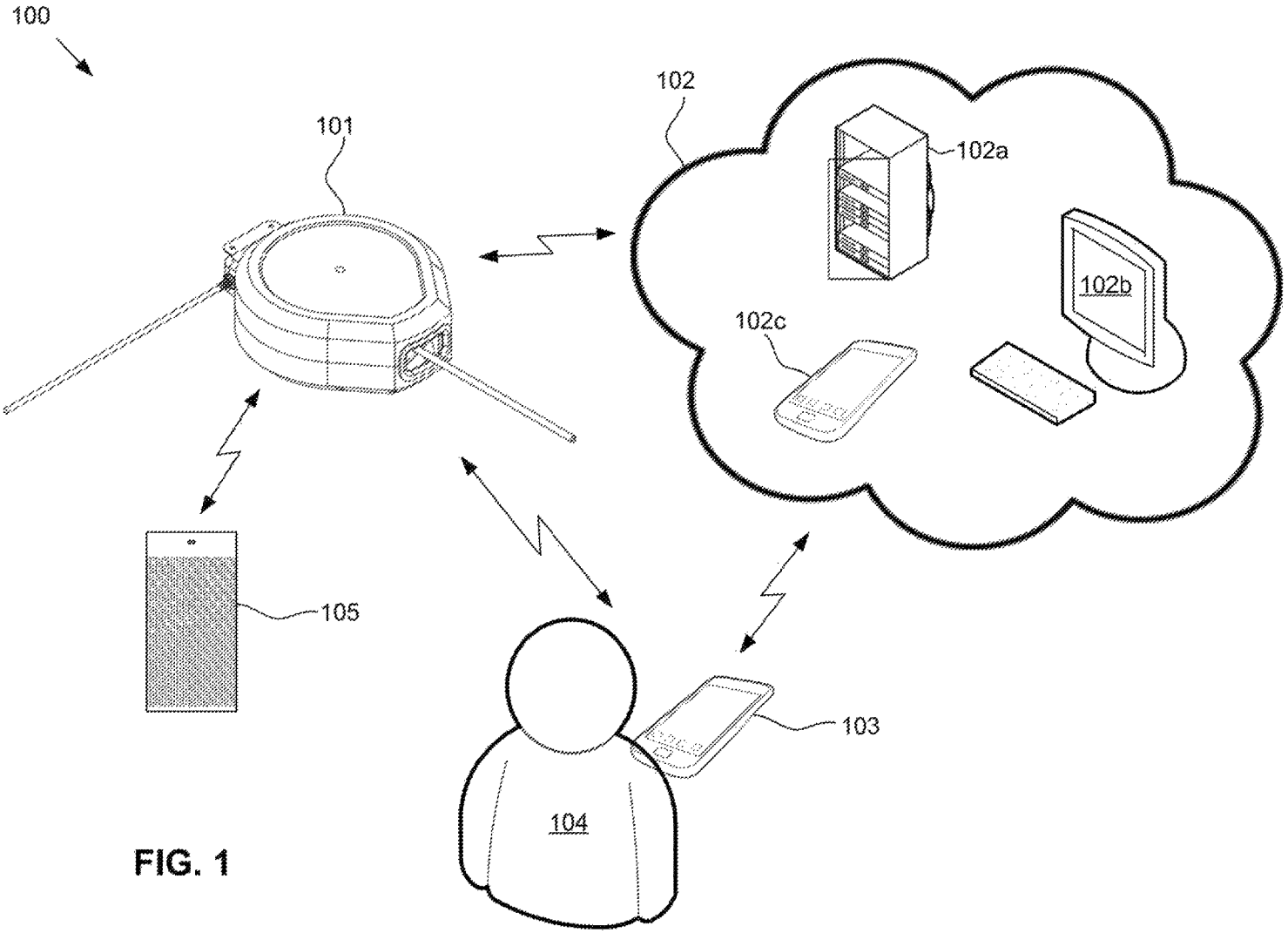
FIG. 1 depicts an inflator system according to one embodiment.

FIG. 1 depicts an inflator system according to one embodiment. The system 100 includes wirelessly controlled inflator 101, cloud network 102 including network devices 102*a,b,c*, wireless control device 103 operated by user 104, and networked smart device 105. The inflator may wirelessly communicate with the cloud network, one or more of the cloud network devices, the wireless control device, or the networked smart device via any of a variety of means, including wireless and wired communication means. Such means may include Ethernet, Wi-Fi, Bluetooth, ZigBee, and/or Z-Wave. Other means may include dual modulation on the 902-928 MHz ISM band using FSK and SSFH, also known as Sure-Fi. Such networks may include local area networks, wireless local area networks, campus area networks, personal area networks, wide area networks, enterprise private networks, metropolitan area networks, storage area networks, and system area networks, among others. Network topologies may include bus, ring, star, and/or mesh topologies.

Other wirelessly controlled devices are also envisioned for use with the system. Thus, in some embodiments, the system includes a wirelessly controlled speaker, a wirelessly controlled light, a wirelessly controlled power cord, a wirelessly controlled motorized lifter, a wirelessly controlled vacuum, a wirelessly controlled radio, and/or one or more wirelessly controlled power tools, among others.

The cloud network may include any of a variety of networks incorporating disparate devices remotely located from each other and linked via one or more wired and/or wireless connections. For example, the cloud network may include a single server wired directly or indirectly to a router that wirelessly communicates with a wirelessly controlled device such as the wirelessly controlled inflator. The server may store instructions for operating the wirelessly controlled device, and/or may relay instructions to the wirelessly controlled device from another cloud-networked device. In some embodiments, the cloud network includes a central server and one or more user nodes. A user may provide instructions to the wirelessly controlled device via the user node and the central server, or may bypass the central server and communicate directly with the wirelessly controlled device. For example, in some embodiments, the user node may store communication instructions that route communications directly to the wirelessly controlled device when within the signal range of a given wireless communication means (e.g. Bluetooth, etc.), and outside that signal range may route communications to the wirelessly controlled device via the server.

The cloud network may include one or more network devices, such as those depicted. The network devices may, in various embodiments, include one or more servers, one or more personal computers, one or more laptop computers, one or more smartphones, and/or one or more tablet computers. Such devices may be real and/or virtual. For example, the cloud network may include a virtual server implemented on a personal computer, a single server blade, or a server cluster. The devices may be organized as client-server, with a hardware device acting as the server, and other hardware devices acting as clients, or the server may be a virtual server formed on several hardware devices.

The wireless control device may include any of a variety of devices capable of wirelessly communicating with the wirelessly controlled device and/or the cloud network. For example, the wireless control device may include a software application implemented on a touchscreen smartphone. However, in some embodiments, the wireless control device may include a remote control with tactile buttons. Other wireless control devices may include a tablet, a personal computer, a laptop, and/or a special-purpose device designated for controlling the wirelessly controlled device.

The networked smart device may include any of a variety of additional devices networked directly and/or indirectly to the inflator. Such networked smart devices may include a wirelessly controlled speaker, a wirelessly controlled light, a wirelessly controlled power cord, a wirelessly controlled motorized lifter, a wirelessly controlled vacuum, a wirelessly controlled radio, and/or one or more wirelessly controlled power tools, among others. The system may include one or more such networked smart devices. The networked smart device may communicate with the wirelessly controlled device via a wired connection and/or a wireless connection, and may include instructions for operation with the wirelessly controlled device. For example, in one embodiment, a compact, wirelessly controlled inflator may be networked to two additional smart devices: a speaker/microphone and an LED light. A user may provide a verbal command to begin operating the inflator. The microphone may relay the verbal command to the inflator's microprocessor. The microprocessor may interpret the verbal command received from the microphone, and may perform an operation, such as activating the inflator. The inflator's microprocessor may also include instructions to turn on the LED light when the inflator is activated, and may send a wireless signal to the LED light to turn on as the inflator is activated.

The system described above may, in various ways, conveniently incorporate a compact inflator that allows for flexible positioning and simple operation. The inflator may, in various embodiments, incorporate various features that enable wireless operation of the inflator. Such features may include various of those described in paragraphs [0027]-[0039] and [0041]-[0051] and depicted in FIGS. 2-12 of U.S. patent application Ser. No. 15/413,905 by David R. Hall et al. on Jan. 24, 2017. At least some of the referenced material is included herein for convenience.

The compact inflator may include a rotatable drum, an air pump, a fixed securing mechanism, a power supply, and an electric power transmission mechanism. The rotatable drum may draw in and/or let out a hose. The hose may include a first end and a second end. The first end may have a connection mechanism that connects the hose to an inflatable object. The air pump may be connected to the second end of the hose. The securing mechanism may provide structural support to the drum. The securing mechanism may also enable rotation of the drum. The power supply may provide power to the pump. The power transmission mechanism may be electrically coupled to one or more of the pump or the power supply, and may include a first portion coupled to the securing mechanism and a second portion coupled to the drum. In some embodiments, the power transmission mechanism may include a slip ring. In some embodiments, the power transmission mechanism may include one or more inductive coils. For example, the power transmission mechanism may include a first inductive coil connected to the securing mechanism and a second conductive coil connected to the drum. The first inductive coil may be maintained within an inductance range of the second inductive coil as the drum rotates.

The drum may be comprised of any of a variety of materials, including plastic, metal, and/or rubber. The drum may serve one or more of several functions. The drum may include an external surface around which the air hose is wound. The interior of the drum may be hollow, or may include various structures that support components, such as the pump, inside the drum. For example, the drum may include a divider disposed within the drum dividing the drum along the circumference of the drum. The pump may, in such embodiments, be affixed to the divider within the drum. The divider may server to separate the pump and various other electronic components from, for example, a rewind mechanism also disposed within the drum. The rewind mechanism may be connected to the drum and the securing mechanism to enable the drum to rotate and rewind the hose onto the drum. For example, the rewind mechanism may include a recoil spring. In embodiments that include the recoil spring, a pawl mechanism may also be included that allows for selective rewinding of the drum.

The rewind mechanism may be incorporated in embodiments without the divider, or may be incorporated in embodiments on the same side of the divider as the pump. For example, in some embodiments, the securing mechanism may extend within the drum. The pump and/or various other internal components may be mounted to the securing mechanism within the drum. The securing mechanism may form a circular shape, and the drum may be supported on the securing mechanism by one or more bearings. The bearings may allow rotation of the drum with respect to the securing mechanism. The pump may include a motor disposed within the drum and movably coupled to the securing mechanism. The motor may include a pinion, and the drum may include a rack. The pinion may move between engagement with a pump gear that allows the motor to power a pumping mechanism and the drum rack. The motor may therefore be used to draw in and/or let out the hose.

The drum and/or the securing mechanism may include an opening through which the hose passes, allowing connection of the hose to the pump. The hose may be comprised of one or more flexible materials that allow the hose to wrap around the drum and flex during use. For example, the hose may be comprised of one or more of nylon, polyurethane, polyethelene, PVC, or one or more natural and/or synthetic rubbers. In various embodiments, the hose may be reinforced with one or more fibers and/or steel cord.

The connection mechanism at the first end of the hose may, in some embodiments, comprise one or more valves. The valve may be manually controllable by a user, or may be electronically controlled. Alternatively/additionally, the connection mechanism may include one or more hose couplers, such as a barbed hose fitting, a hose ferrule, and/or a quick-connect coupler. The connection mechanism may include a one or more valve adapters, such as any of a variety of stem valve adapters. The hose may be connected to the air pump in any of a variety of similar ways. In some embodiments, the hose may be rotatably connected to the pump to allow the hose to rotate with the drum. This may be beneficial in embodiments where the pump remains fixed as the drum rotates.

The air pump may include a motor portion and a pumping portion. The motor and pumping portions may, in some embodiments, be separate components connected by one or more gears. In some embodiments, the motor and pumping portions may be incorporated as a unitary part. The motor may be a variable speed AC or DC motor. The pumping portion may include a plunger, a diaphragm, a piston, or a radial piston, among others.

The fixed securing mechanism may be comprised of any of a variety of materials, including plastic, rubber, and/or metal. The securing mechanism may be fixed to one or more surfaces, and/or otherwise held immovable, to allow rotation of the drum by providing a counter force to the force exerted that causes rotation of the drum. The securing mechanism may take many different shapes, and may include any of a variety of features. For example, in some embodiments, the securing mechanism may include a pivot portion passing through the center of the drum, about which the drum may rotate, and may include one or more mounting portions coupled to the pivot portion. The mounting portions may include one or more structures, such as mounting brackets, that allow the securing mechanism to be mounted to a surface. The securing mechanism may also include and/or support various other components of the inflator, such as the power supply and/or one or more electrical wires coupling internal components of the inflator to external power. The power supply may include any of a variety of power supplies, such as a battery or a power cord coupled to mains electricity or some other external power supply. The electrical wires may be coupled to the electrical power transmission mechanism, such as the slip ring or the set of complementary inductive coils.

The securing mechanism may be embodied as a housing that surrounds or at least partially surrounds the drum. In addition, or alternatively, to the features described above, the housing may include various other features, such as electrical wiring to conduct power to the pump, a mount and/or container for various hose attachments, a baffle to attenuate sound from the pump, and/or an opening through which the hose passes. The opening may include rounded edges that prevent damage to the hose that might otherwise be caused by rubbing and/or being forced against the housing.

In various embodiments, the pump may rotate with respect to the power supply and/or elements within the electrical chain coupling the power supply to the pump. For example, in one embodiment, the power supply may include a power cord running to the inflator and coupled to electrical wires on the securing mechanism. The electrical wires may run through and/or across the securing mechanism to the power transmission mechanism. In some embodiments, the power transmission mechanism may include a slip ring. The first portion of the power transmission mechanism (described above as coupled to the securing mechanism) may include a conductive ring and the second portion the power transmission mechanism (described above as coupled to the drum) may include a conductive brush in electrical contact with the conductive ring. Alternatively, the first portion may include the conductive brush and the second portion may include the conductive ring.

The conductive ring may be disposed on a portion of the housing, such as on a surface of the baffle facing in towards the drum. The brushes may be connected to the divider, such as by one or more columns that extend from the divider. Alternatively, the conductive ring may be coupled to the drum, such as by columns extending from the divider, and the conductive brushes may be coupled to the housing. In an alternative embodiment, the conductive ring is disposed on the drum around the outside circumference of the drum, such as along one or both edges of the drum. The brushes extend from the securing mechanism to form electrical contact with the ring. One ring may be provided for the positive side of the circuit and one for the negative side. Another ring may also be provided to communicate data. Several rings may be provided for data. In an alternative embodiment, the ring may be disposed along the housing surrounding the drum, and the brush may be disposed on an outside edge of the drum.

Some embodiments may include the inductive coils described above. For example, in one embodiment, the first inductive coil may be connected to the pivot mechanism about which the drum rotates. The second inductive coil may be aligned parallel to the first inductive coil, and may rotate around the first inductive coil as the drum rotates. The inductive coils may be disposed in protective shielding, either separately or jointly. For example, in one embodiment, the drum includes shielding around the second inductive coil that encompasses the first inductive coil and rotates with the drum. The shielding may include openings through which conductive wiring, fixed to the securing mechanism, may pass, and the shielding may rotate around the conductive wiring. A rectifier may be included to convert AC current from the inductive coils to DC current to power the pump and/or other electronic components disposed within the drum.

Figure 2:
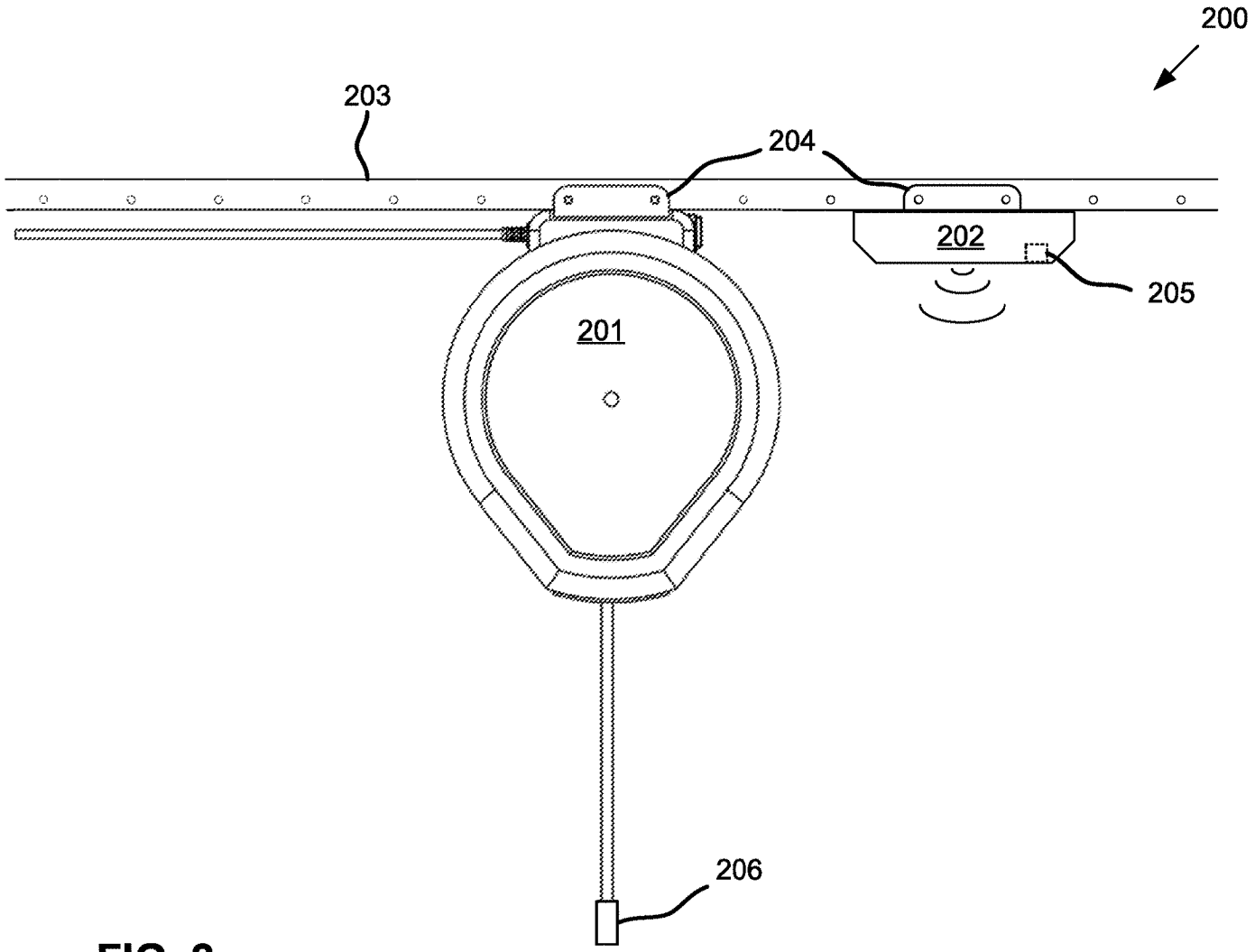
FIG. 2 depicts a mounted inflator and a corresponding networked device.

FIG. 2 depicts a mounted inflator and a corresponding networked device. The system 200 includes a wirelessly controlled inflator 201, a wirelessly controlled speaker 202, a mounting track 203, universal mounting brackets 204, a camera 205, and a hose connection mechanism 206. The mounting track may allow the inflator and the speaker to be mounted, via the universal mounting brackets, to a ceiling or other overhead surface. Though the inflator and speaker may not be placed at a convenient reaching height, both devices may be wirelessly controlled, as is described above. The inflator may include some and/or all of the features described above. Because of the inflator's compact design, the inflator may be easily mounted overhead.

The wirelessly controlled speaker and camera may be used to control the inflator. For example, the speaker may include a microphone that receives audio commands from a user. The audio commands may be transmitted to a cloud-based processor, interpreted, and forwarded to the inflator. Similarly, the camera may receive visual cues from a user that are transmitted to a cloud-based processor, interpreted, and forwarded to the inflator.

The connection mechanism may allow the hose to be connected to any of a variety of inflatable objects. Such objects may include bicycle tires, car tires, toys, and balls, among others. The connection mechanism may also include a constrictor that increases the pressure of air flow from the hose. Such a mechanism may be used as a blower to clear debris and/or dry an object, among other uses.

Figure 3:
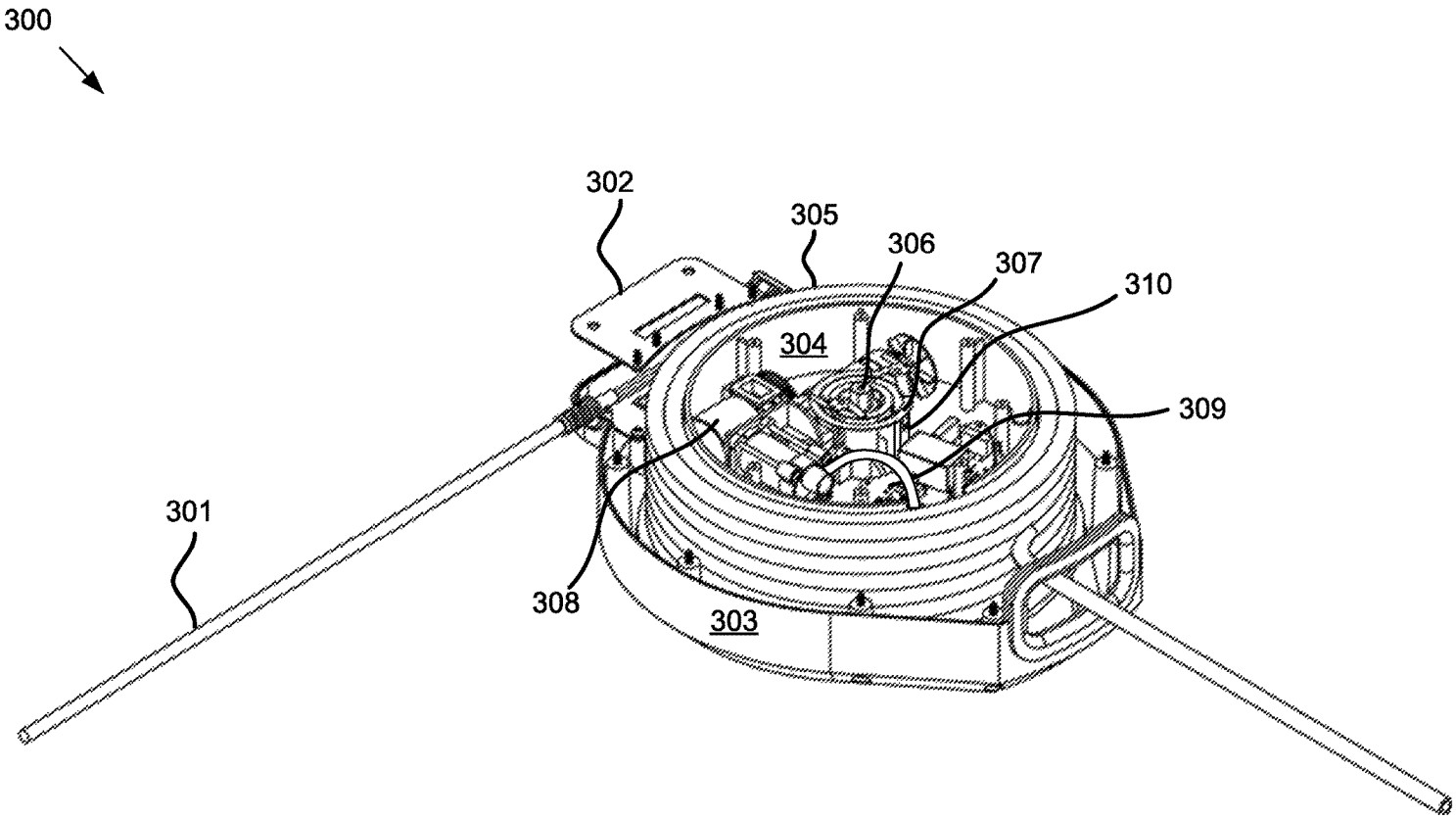
FIG. 3 depicts an isometric view of an inflator embodiment with a portion of the housing removed to expose various internal components.

FIG. 3 depicts an isometric view of an inflator embodiment with a portion of the housing removed to expose various internal components. The inflator 300 includes a power cord 301, a mounting bracket 302, housing 303, a rotatable drum 304, an air hose 305, a drum pivot 306, slip rings 307, a pump 308, and a printed circuit board 309. The pump and printed circuit board are fixed to the interior surface of the drum, and thus rotate with the drum as the air hose is wound on, and unwound from, the drum. Electrical wiring running along the portion of the housing removed (not shown) electrically couple the slip rings to the power cord. The slip rings conduct power to the electrical components, such as the pump and the printed circuit board, fixed inside the drum. The slip rings are coupled to the drum by columns 310 extending from the drum.

The printed circuit board may support various electronic components for controlling the pump. Such components may include a transceiver, a controller, and a pressure sensor. The controller may store instructions for operating the pump based on control instructions received via the receiver.

Figure 4:
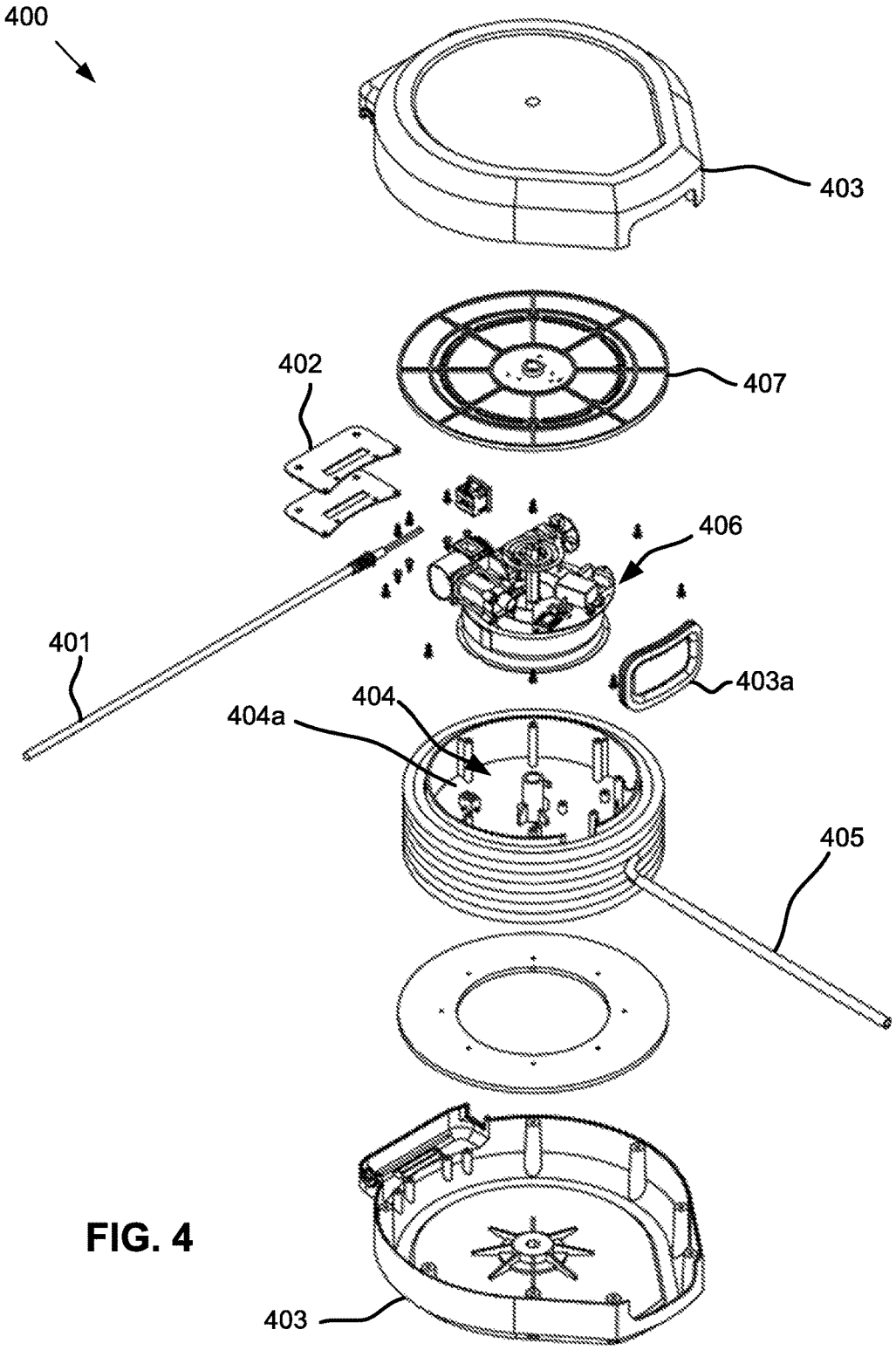
FIG. 4 depicts and exploded view of an inflator according to one embodiment.

FIG. 4 depicts and exploded view of an inflator according to one embodiment. The inflator 400 includes a power cord 401, a mounting bracket 402, housing 403 including a hose opening 403*a*, a rotatable drum 404, a drum divider 404*a*, an air hose 405, internal drum components 406, and a vented baffle 407. The internal drum components, which include the pump and various electronics, are enclosed within the drum by the baffle. Space is provided between the baffle and the housing such that air flows through the hose opening and the baffle to the pump. The structure of the baffle and the housing provide some noise attenuation. The drum divider provides a surface on which the internal components may be mounted, which may include a pump, a printed circuit board, and a rewind mechanism.

Figure 5:
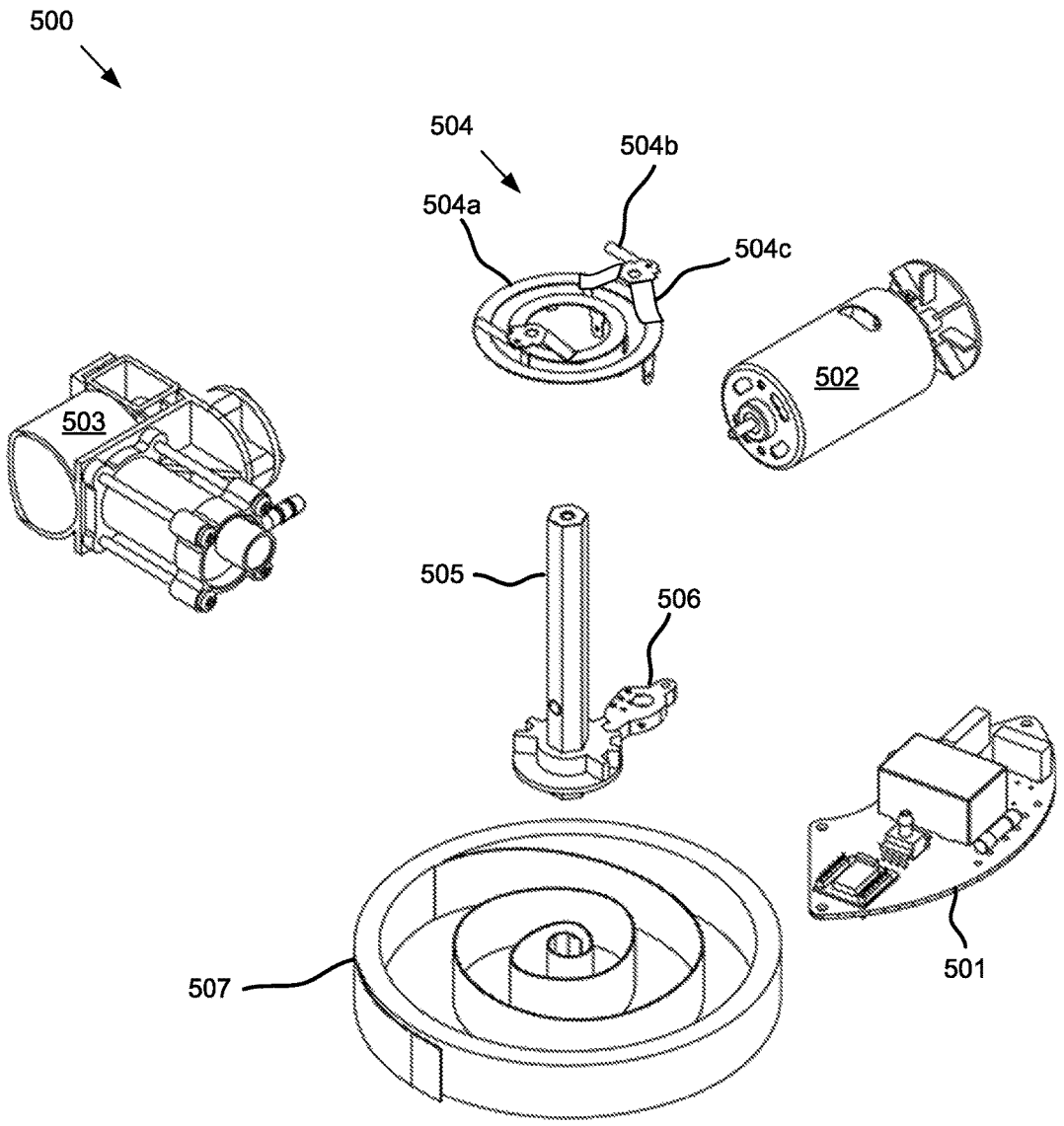
FIG. 5 depicts an exploded view of various internal components of an inflator according to one embodiment.

FIG. 5 depicts an exploded view of various internal components of an inflator according to one embodiment. The inflator 500 includes a printed circuit board 501, a motor 502, a pump 503, electrical power transmission mechanism 504, a drum pivot 505, a pawl mechanism 506, and a recoil spring 507. The electrical power transmission mechanism includes slip rings 504*a*, power lines 504*b*, and conductive brushes 504*c*. The slip rings provide power to the printed circuit board and the motor. The motor drives the pump. The recoil spring is fixed at one end to the drum pivot and at the other end to the drum, and enables the drum to rewind the hose. The pawl mechanism fixes the drum and prevents the spring from recoiling. As used herein, "recoil" refers to a return to a state of equilibrium of a spring, either from compression, expansion, coiling, or uncoiling.

Figure 6:
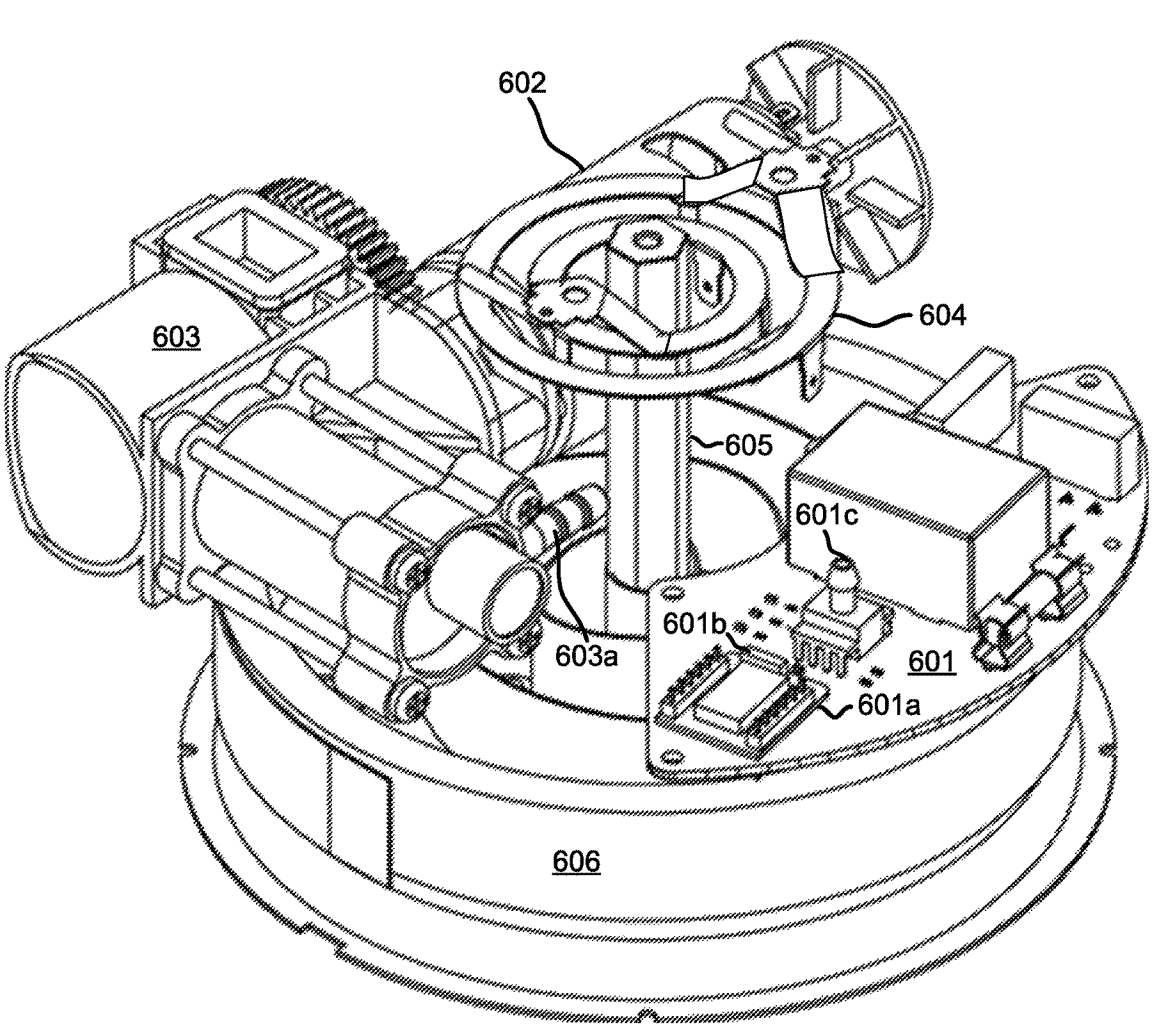
FIG. 6 depicts an assembled view of various internal components of an inflator according to one embodiment.

FIG. 6 depicts an assembled view of various internal components of an inflator according to one embodiment. The inflator 600 includes a printed circuit board 601 having a programmable switch 601*a* and a wireless transceiver 601*b*, a pressure sensor 601*c*, a motor 602, a pump 603, a hose barb adaptor 603*a*, slip rings 604, a drum pivot 605, and a recoil spring 606. A hose couples to the pump via the barb adaptor, then to a t-connector (not shown), which couples to another hose and the pressure sensor. The second hose wraps around the drum within which the depicted components are disposed.

Figure 7:
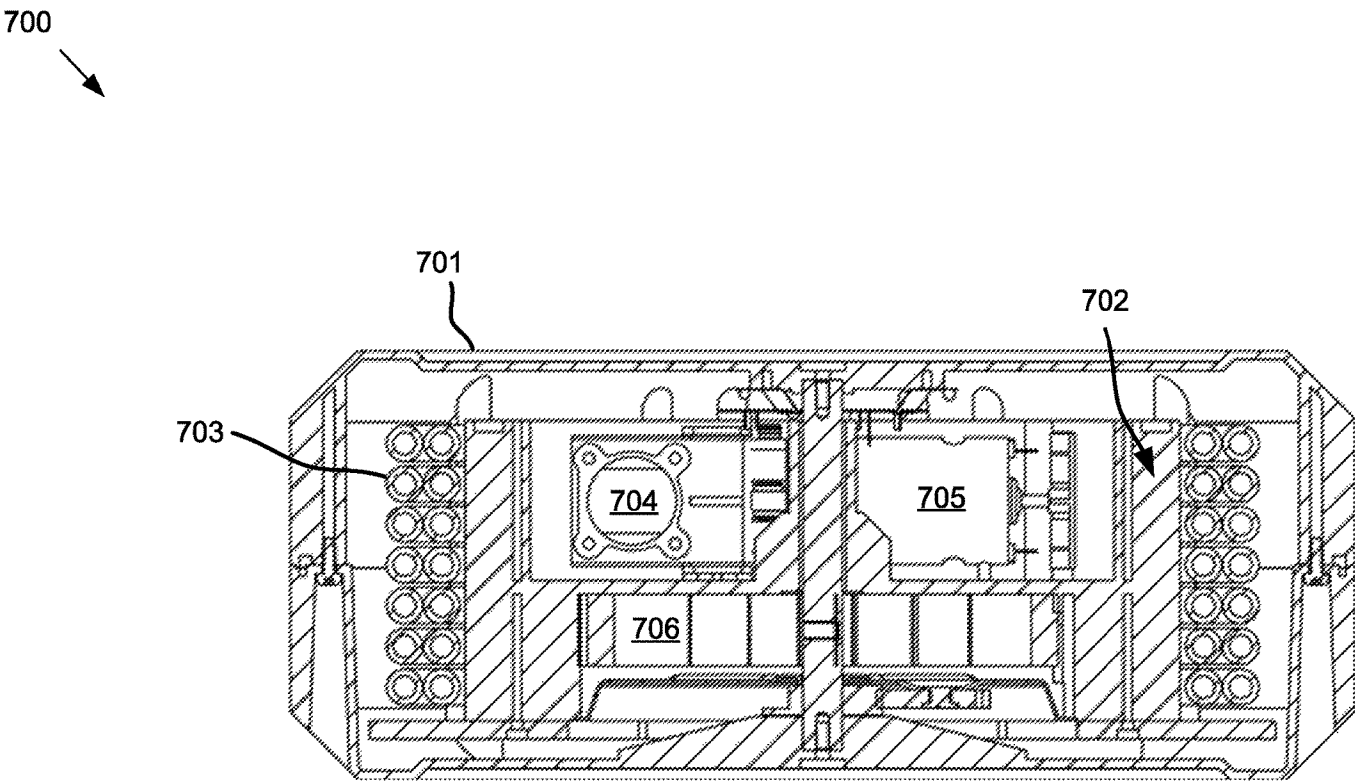
FIG. 7 depicts a cross-sectional view of an inflator according to one embodiment.

FIG. 7 depicts a cross-sectional view of an inflator according to one embodiment. The inflator 700 includes housing 701, a drum 702, a hose 703, a pump 704, a motor 705, and a recoil spring 706. The housing completely surrounds the drum, hose, pump, motor, and recoil spring, and the hose extends from the drum through the housing similar to that described above.

Figure 8:
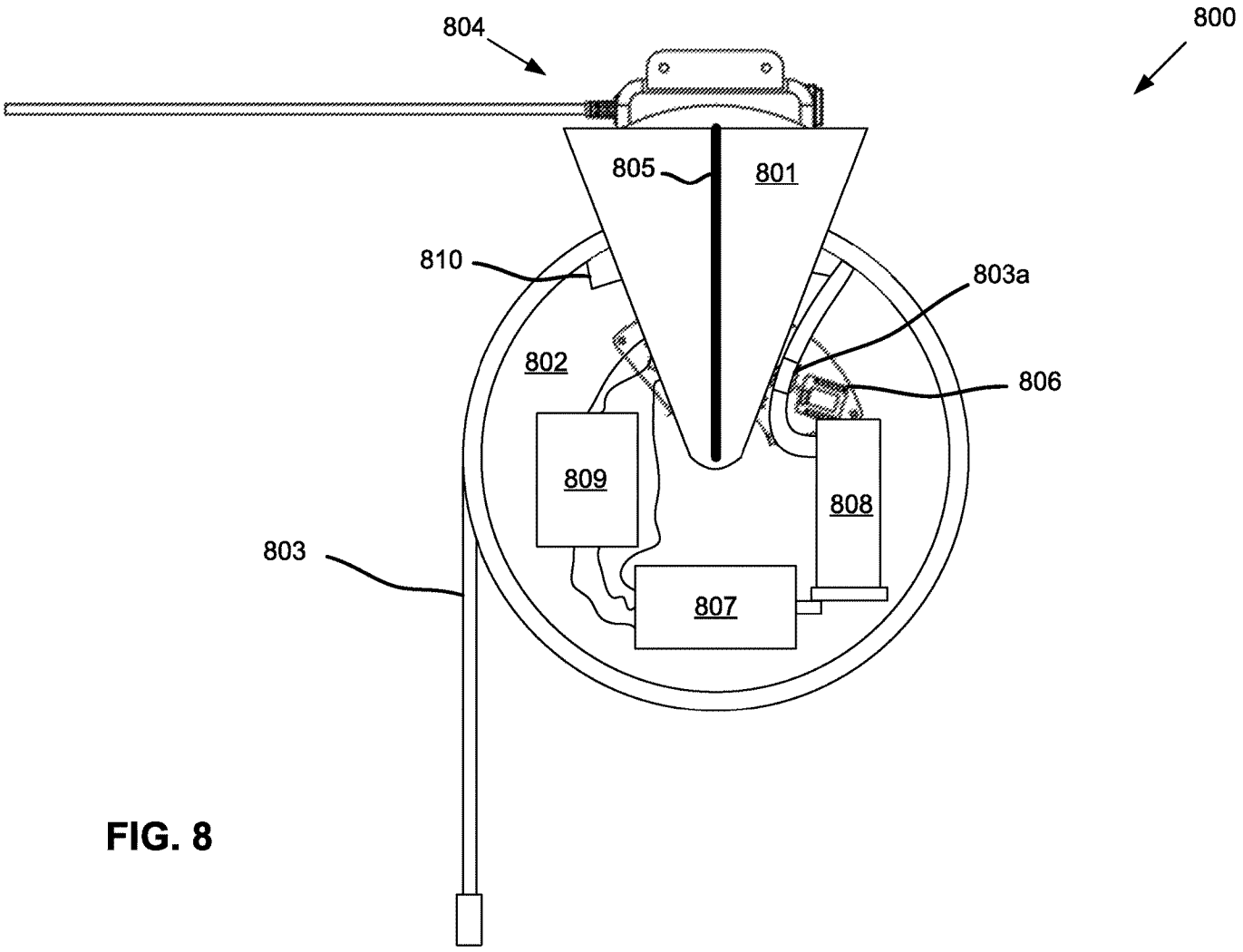
FIG. 8 depicts a top view of one inflator embodiment.

FIG. 8 depicts a top view of one inflator embodiment. The inflator 800 includes a fixed securing mechanism 801, a drum 802, a hose 803, a power supply 804, a power line 805, a printed circuit board (PCB) 806, a motor 807, a pump 808, a battery 809, and a counter-weight 810. Power supply 804 may provide power from mains electricity to the PCB, battery, and/or the motor via the power line. The power line may be coupled to a power transmission mechanism (embodiments of which are described throughout) to allow rotation of the drum with respect to the securing mechanism and still allow power to be transmitted to the internal components affixed to the drum. The hose is coupled to the pump, and includes a T-valve 803*a* that couples to a pressure sensor on the PCB. The counter weight is disposed in the drum opposite the battery, motor, and pump to enable smooth rotation of the drum.

Figure 9:
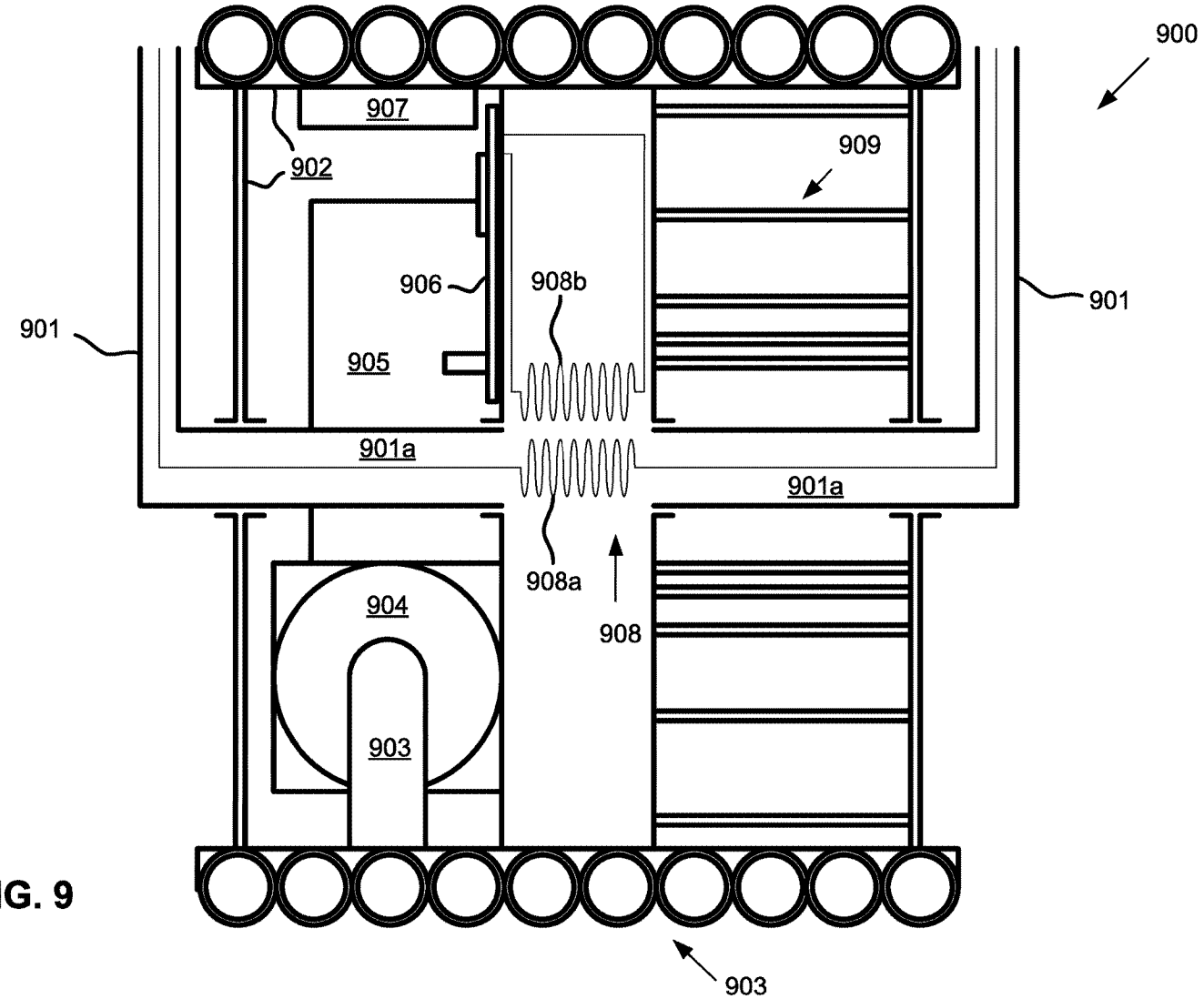
FIG. 9 depicts a cross-section of one inflator embodiment.

FIG. 9 depicts a cross-section of one inflator embodiment. The inflator 900 includes a fixed securing mechanism 901, a pivot mechanism 901*a*, a drum 902, a hose 903, a pump 904, a motor 905, a printed circuit board 906, a counter-weight 907, an electrical power transmission mechanism 908, and a rewind mechanism 909. The power transmission mechanism includes a first inductive coil 908*a* and a second inductive coil 908*b*. The first inductive coil is affixed to the securing mechanism, and the second inductive coil is affixed to the drum. The second inductive coil rotates around the first inductive coil as the drum rotates around the securing mechanism, remaining within an inductive range of the first inductive coil, and thereby allowing constant power delivery to the internal components of the drum.

Figure 10:
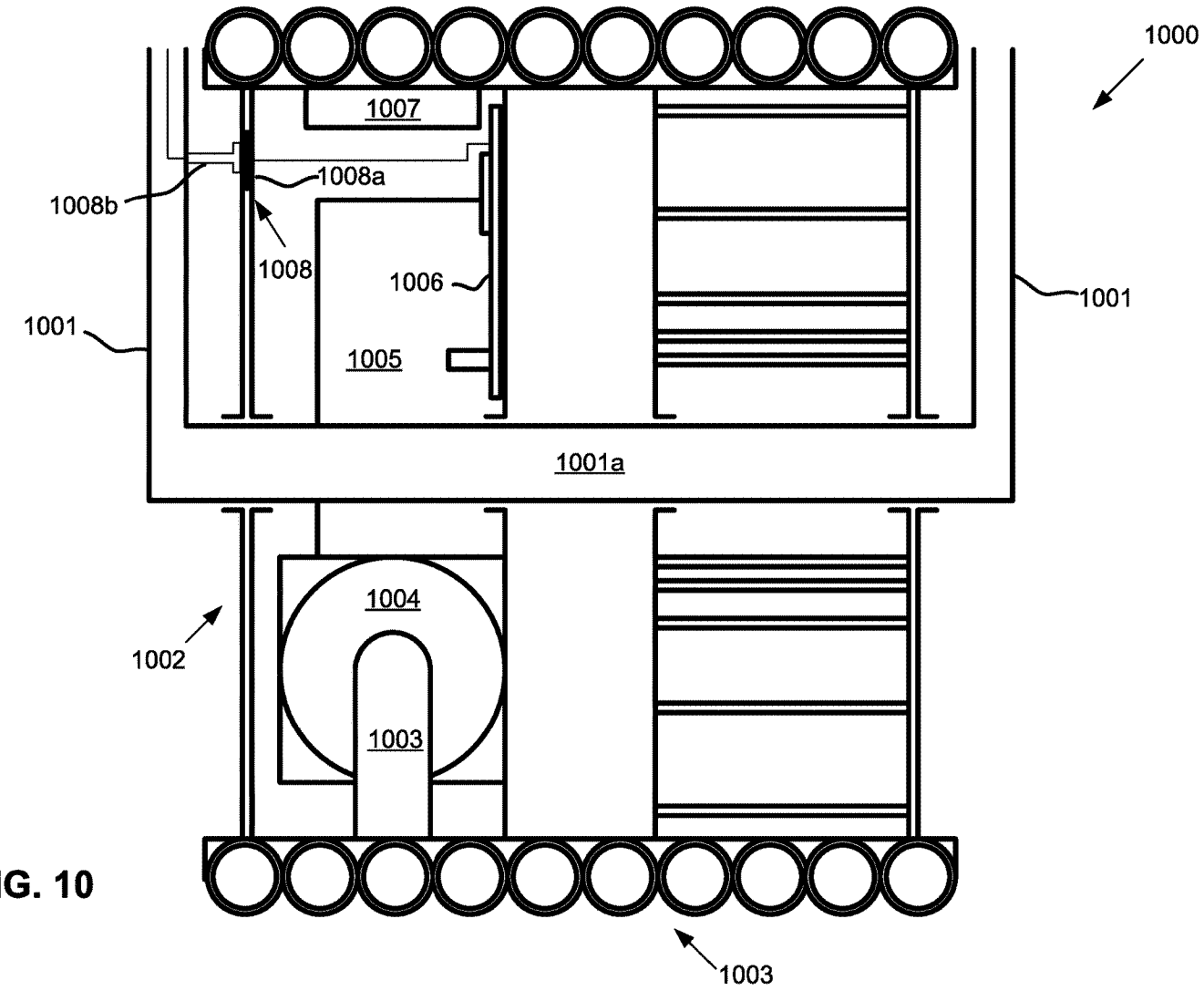
FIG. 10 depicts a cross-section of one inflator embodiment similar to that depicted in FIG. 9, including a different electrical power transmission mechanism.

FIG. 10 depicts a cross-section of one inflator embodiment similar to that depicted in FIG. 9, including a different electrical power transmission mechanism. The inflator 1000 includes a fixed securing mechanism 1001, pivot mechanism 1001*a*, a drum 1002, a hose 1003, a pump 1004, a motor 1005, a printed circuit board 1006, a counter-weight 1007, and an electrical power transmission mechanism 1008. The power transmission mechanism includes a conductive ring 1008*a* disposed on a face of the drum and a conductive brush 1008*b* disposed on the securing mechanism. The conductive ring is electrically coupled to the PCB, and the conductive brush is electrically coupled to a power supply.

Figure 11A:
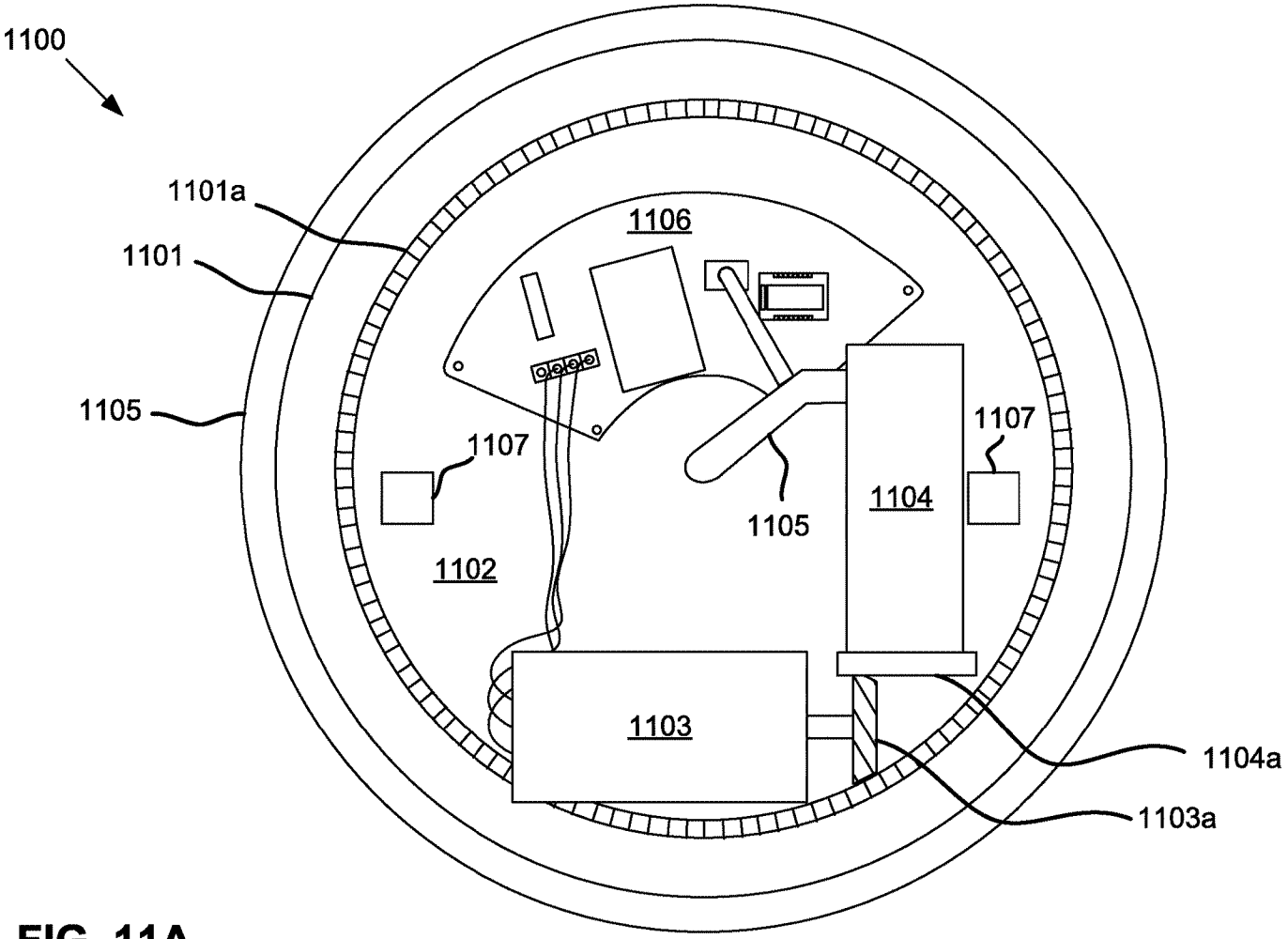
FIGS. 11A-B depict a cross-section of one inflator embodiment including a movable motor disposed within the drum.
Figure 11B:
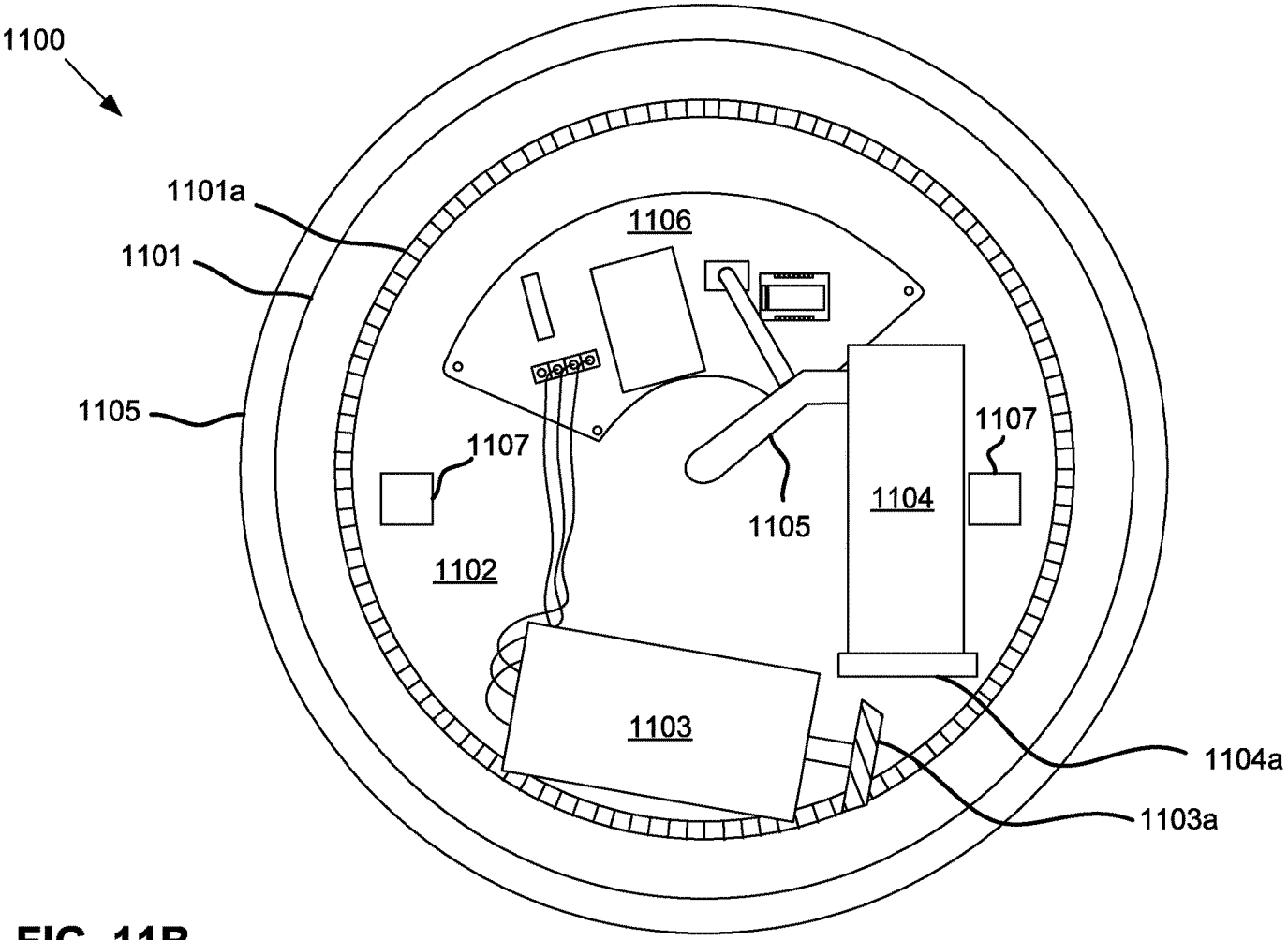

FIGS. 11A-B depict a cross-section of one inflator embodiment including a movable motor disposed within the drum. The inflator 1100 includes a rotatable drum 1101 having a rack 1101*a*, a securing mechanism 1102, a motor 1103 having a pinion 1103*a*, a pump 1104 having a pump gear 1104*a*, a hose 1105, and a printed circuit board 1106. The securing mechanism may support the drum via one or more bearings that allow the drum to rotate with respect to the securing mechanism. The motor may be fixed to the securing mechanism by a second motor (not shown) that rotates the motor between various positions. As shown in FIG. 11A, the pinion may engage with the pump gear in a first position. As shown in FIG. 11B, the pinion may engage with the rack in a second position. The PCB may support a controller that stores instructions to rotate the motor via the second motor. As the pinion engages with the rack, the motor may cause the drum to rotate, winding or unwinding the hose. A pawl mechanism may secure the drum as the pinion engages the pump gear to prevent rotation of the drum. The pawl mechanism may be engaged and/or disengaged by the second motor. The securing mechanism may include one or more mounts 1107 that extend from the surface on which the interior components are affixed. The mounts may mount the inflator to a surface.

We claim:

1. An inflator, comprising:

a rotatable drum that draws in and lets out a hose, the hose comprising a first end and a second end, the first end having a connection mechanism that connects the hose to an inflatable object;

an air pump disposed within the drum and connected to the second end of the hose;

a housing that provides structural support to, and enables rotation of, the drum;

a power supply that provides power to the pump; and an electric power transmission mechanism electrically coupled to one or more of the pump or the power supply between the pump and the power supply, the power transmission mechanism comprising a slip ring assembly;

the pump comprising a motor, the motor movably disposed within the drum, wherein the motor comprises a pinion, and wherein the pinion moves between engagement with a pump gear and a drum rack, wherein the motor rotates the drum at least to draw in the hose.

2. The invention of claim 1, wherein the motor rotates the drum to draw in and let out the hose.

3. The invention of claim 2, further comprising a pawl mechanism to secure the drum, to prevent rotation of the drum, as the pinion engages the pump gear.

4. The invention of claim 1, further comprising a second motor to rotate the motor between engagement with the pump gear and the drum rack.

5. The invention of claim 1, wherein the inflator is adapted to communicate with and receive commands from a wireless control device.

6. The invention of claim 1, wherein the inflator is adapted to communicate with a cloud network.

7. The invention of claim 1, wherein the power supply comprises a battery.

8. An inflator, comprising:

a rotatable drum that draws in and lets out a hose, the hose comprising a first end and a second end, the first end having a connection mechanism that connects the hose to an inflatable object;

an air pump disposed within the drum and connected to the second end of the hose;

a housing that provides structural support to, and enables rotation of, the drum;

a power supply that provides power to the pump; and an electric power transmission mechanism electrically coupled to one or more of the pump or the power supply between the pump and the power supply, the power transmission mechanism comprising a slip ring assembly;

the pump comprising a motor, the motor movably disposed within the drum, wherein the motor comprises a motor gear, and wherein the motor gear moves between engagement with a pump gear and a drum gear, wherein the motor rotates the drum at least to draw in the hose.

9. The invention of claim 8, wherein the motor rotates the drum to draw in and let out the hose.

10. The invention of claim 8, further comprising a pawl mechanism to secure the drum, to prevent rotation of the drum, as the motor gear engages the pump gear.

11. The invention of claim 8, further comprising a second motor to rotate the motor between engagement with the pump gear and the drum rack.

12. The invention of claim 8, wherein the inflator is adapted to communicate with and receive commands from a wireless control device.

13. The invention of claim 8, wherein the inflator is adapted to communicate with a cloud network.

14. The invention of claim 8, wherein the power supply comprises a battery.

* * * * *